US010046897B2

(12) United States Patent
Ball et al.

(10) Patent No.: US 10,046,897 B2
(45) Date of Patent: Aug. 14, 2018

(54) BAGS, GRAVITY FED BAGS, AND USES THEREOF

(71) Applicant: EXOPACK LLC, Spartanburg, SC (US)

(72) Inventors: Joshua Ball, Spartanburg, SC (US); Cory VanLoocke, Spartanburg, SC (US); S. Cory Blanton, Spartanburg, SC (US)

(73) Assignee: Coveris Flexibles US LLC, Chicago, IL (US)

( * ) Notice: Subject to any disclaimer, the term of this patent is extended or adjusted under 35 U.S.C. 154(b) by 0 days.

(21) Appl. No.: 15/021,339

(22) PCT Filed: Sep. 12, 2014

(86) PCT No.: PCT/US2014/055372
§ 371 (c)(1),
(2) Date: Mar. 11, 2016

(87) PCT Pub. No.: WO2015/038880
PCT Pub. Date: Mar. 19, 2015

(65) Prior Publication Data

US 2016/0221738 A1 Aug. 4, 2016

Related U.S. Application Data

(60) Provisional application No. 61/877,190, filed on Sep. 12, 2013, provisional application No. 61/889,588,
(Continued)

(51) Int. Cl.
*B65D 75/58* (2006.01)
*B65D 75/56* (2006.01)
(Continued)

(52) U.S. Cl.
CPC ..... *B65D 75/5844* (2013.01); *B65D 71/063* (2013.01); *B65D 75/008* (2013.01);
(Continued)

(58) Field of Classification Search
CPC ..... B65D 75/5844; B65D 75/566; B65D 75/5855; B65D 75/5838; B65D 83/08; B65D 2575/586
(Continued)

(56) References Cited

U.S. PATENT DOCUMENTS 5,046,457 A * 9/1991 Ashcroft ..... A01K 1/0125 119/168
5,065,868 A * 11/1991 Cornelissen ..... B65D 33/02 206/440
(Continued)

FOREIGN PATENT DOCUMENTS

FR 2094791 A7 2/1972
WO 200198172 A1 12/2001
(Continued)

OTHER PUBLICATIONS

PCT/US2014/055372, International Search Report and Written Opinion, dated Dec. 18, 2014, 14 pages.
(Continued)

*Primary Examiner* — Steven A. Reynolds
(74) *Attorney, Agent, or Firm* — Holland & Hart

(57) ABSTRACT

A bag can include a first wall, a second wall, a third wall, and a fourth wall. The bag can further include a fifth wall, and can be formed as a flat-bottom bag. The bag can also include an opening that is disposed on the first wall of the bag. The opening can be disposed at a lower portion, a middle portion, or an upper portion of the wall. A label, such as a peelable label, can be used to close the opening. A resealable flap can also be used to close the opening if desired.

20 Claims, 13 Drawing Sheets

Related U.S. Application Data filed on Oct. 11, 2013, provisional application No. 61/943,239, filed on Feb. 21, 2014.

(51) Int. Cl.
*B65D 71/06* (2006.01)
*B65D 75/00* (2006.01)
*B65D 83/02* (2006.01)
*B65D 83/08* (2006.01)

(52) U.S. Cl.
CPC ..... *B65D 75/566* (2013.01); *B65D 75/5838* (2013.01); *B65D 75/5855* (2013.01); *B65D 83/02* (2013.01); *B65D 83/0805* (2013.01); *B65D 2313/02* (2013.01); *B65D 2571/0045* (2013.01); *B65D 2571/00672* (2013.01); *B65D 2571/00845* (2013.01); *B65D 2575/586* (2013.01)

(58) Field of Classification Search
USPC ..... 206/494, 427, 459.5; 221/306
See application file for complete search history.

(56) References Cited

U.S. PATENT DOCUMENTS 5,163,558 A * 11/1992 Palumbo ..... B65D 75/5833 206/494
5,842,790 A * 12/1998 Imer ..... B65D 75/008 383/104
5,868,227 A * 2/1999 Garcia ..... A45C 5/06 150/106
6,126,009 A * 10/2000 Shiffler ..... B65D 75/5838 206/233
6,334,710 B1 1/2002 Kuge et al.
6,453,845 B1 * 9/2002 Efrati ..... A01K 1/0125 119/165
6,918,532 B2 * 7/2005 Sierra-Gomez .... B65D 75/5838 206/459.1
7,717,620 B2 5/2010 Hebert et al.
8,297,840 B2 10/2012 Jansen
8,545,099 B2 * 10/2013 Davis ..... B29C 59/007 220/266
D765,479 S * 9/2016 Lambin ..... D8/5
2004/0232029 A1 * 11/2004 Cotert ..... B65D 75/5838 206/494
2006/0138159 A1 6/2006 Altuve et al.
2009/0226117 A1 9/2009 David et al.
2011/0180553 A1 7/2011 Surdziel

FOREIGN PATENT DOCUMENTS

WO 2004087527 A1 10/2004
WO 2015038880 A2 3/2015

OTHER PUBLICATIONS 14844617.2, Supplementary European Search Report, dated Feb. 3, 2017, 7 pages.

* cited by examiner

BAGS, GRAVITY FED BAGS, AND USES THEREOF

RELATED APPLICATIONS

This application is the U.S. National Stage filing under 35 U.S.C. 371 of International Patent Application No. PCT/US2014/055372, filed on Sep. 12, 2014 and titled BAGS, GRAVITY FED BAGS, AND USES THEREOF, which claims the benefit of U.S. Provisional Application No. 61/877,190, filed on Sep. 12, 2013 and titled GRAVITY FED BAGS, U.S. Provisional Application No. 61/889,588, filed on Oct. 11, 2013 and titled GRAVITY FED BAGS, and U.S. Provisional Application No. 61/943,239, filed on Feb. 21, 2014 and titled BAGS, GRAVITY FED BAGS, AND USES THEREOF, each of which is incorporated herein by reference in its entirety.

TECHNICAL FIELD

The present disclosure relates generally to bags, and more particularly to bags that include an opening disposed on a wall of the bag.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
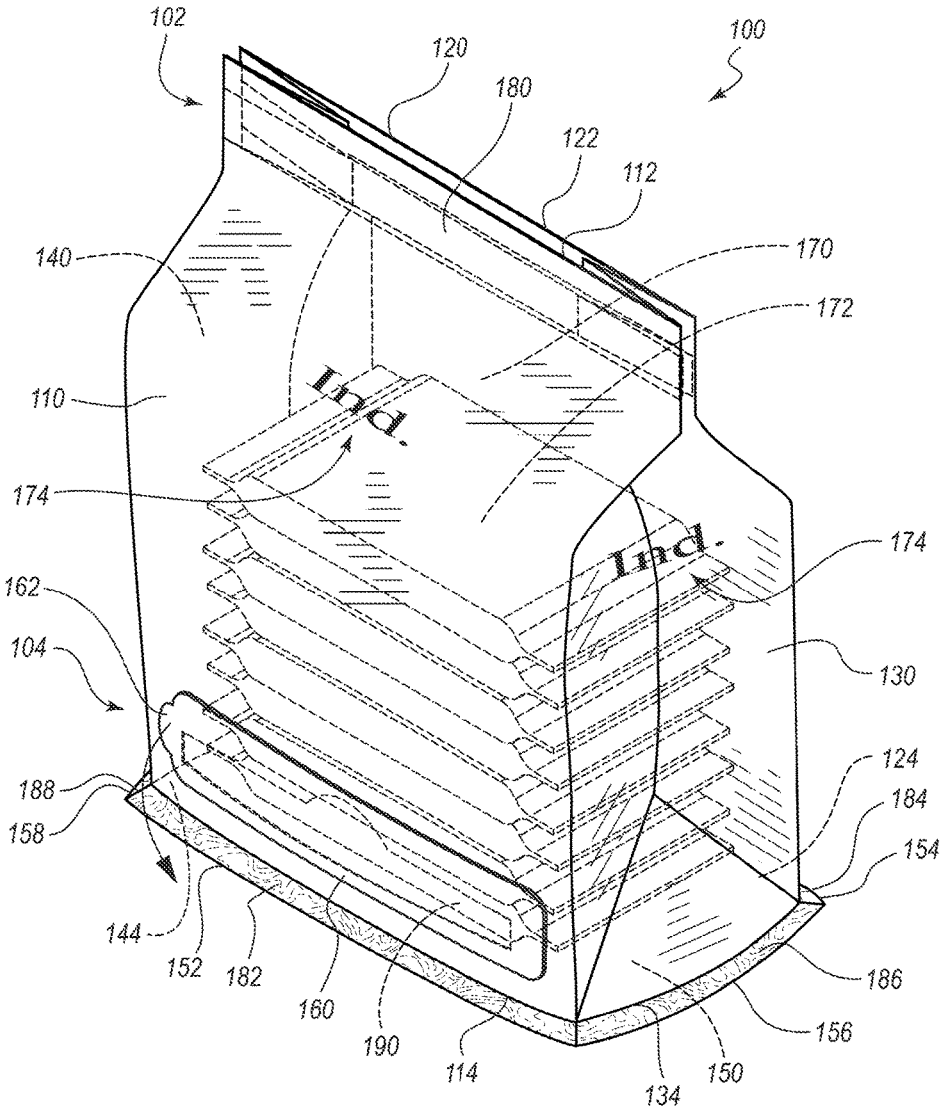
FIG. 1 is a perspective view of an embodiment of a bag in a closed or sealed state.

Embodiments may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. In some cases, well-known structures, materials, or operations are not shown or described in detail. While the various aspects of the embodiments are presented in drawings, the drawings are not necessarily drawn to scale unless specifically indicated.

Figure 2:
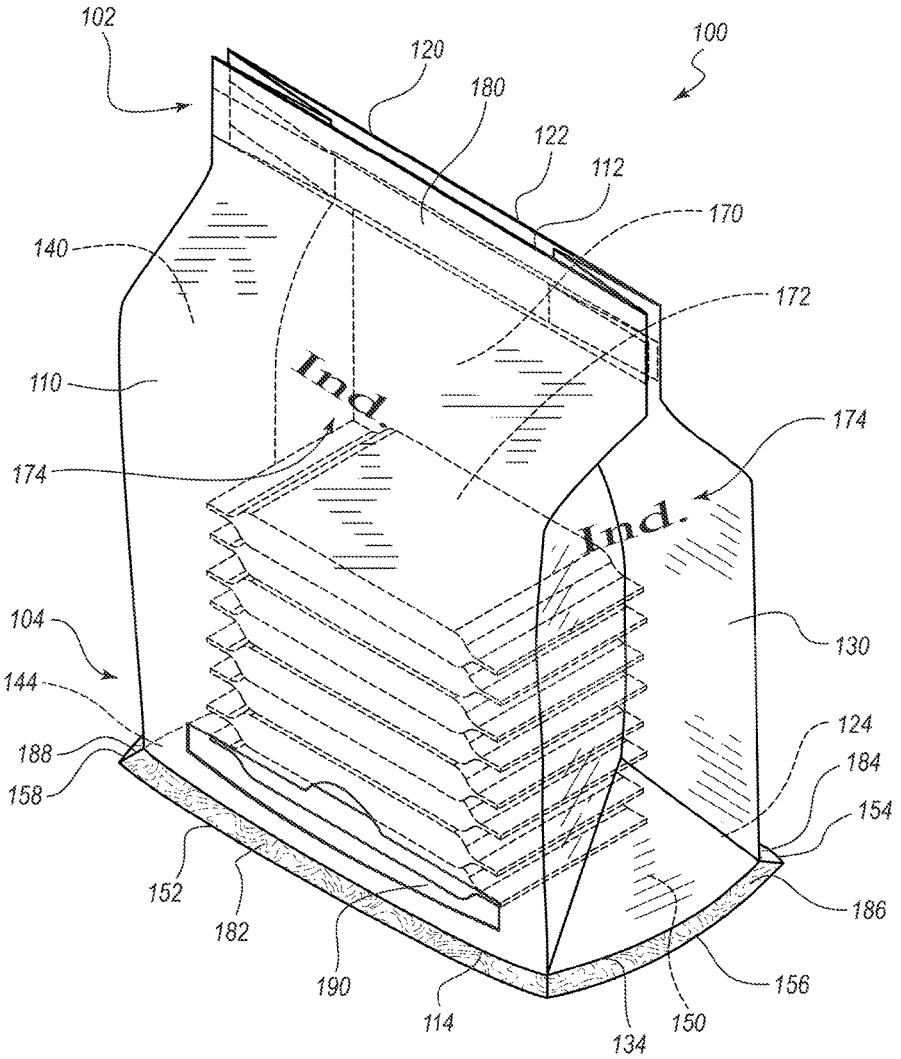
FIG. 2 is a perspective view of the bag of FIG. 1 in an open or unsealed state.
Figure 3:
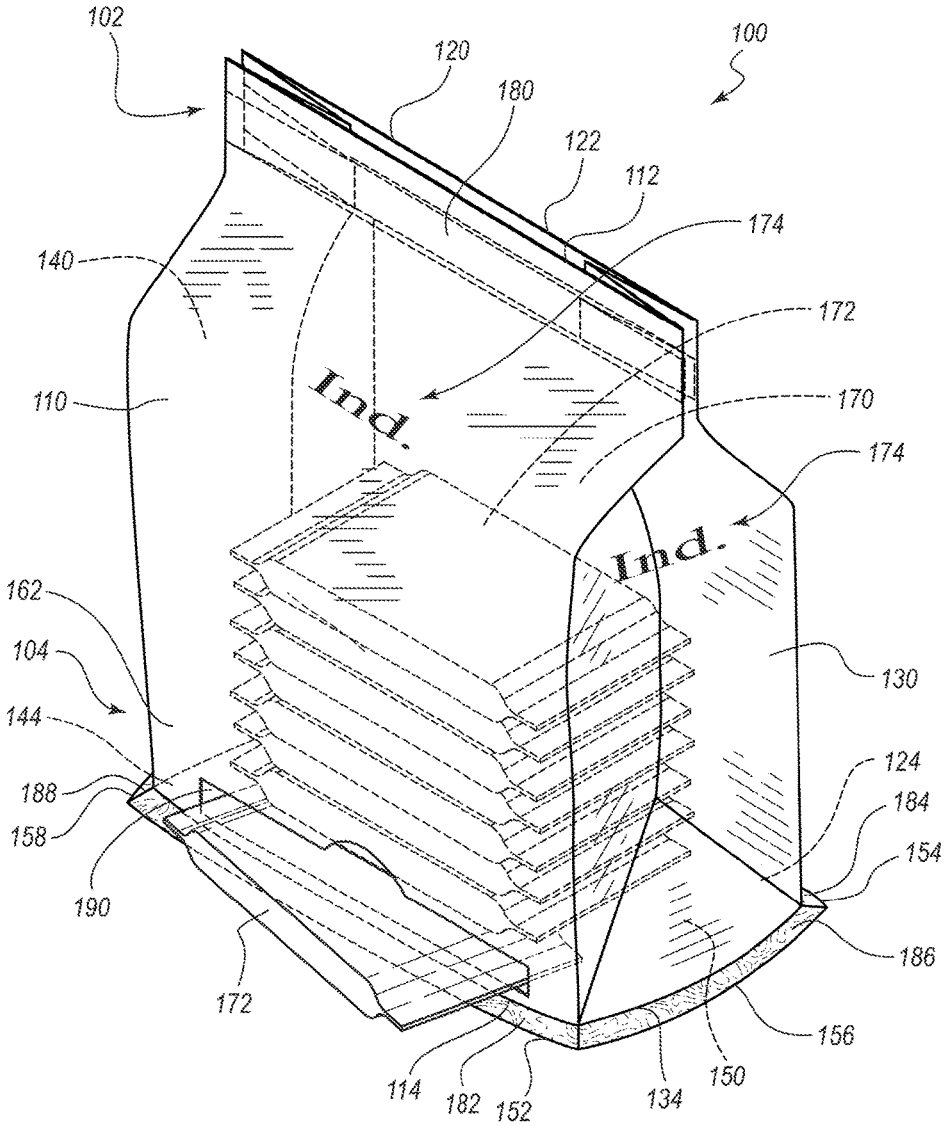
FIG. 3 is another perspective view of the bag of FIG. 1 in an open or unsealed state that depicts a product being removed from the bag.

FIGS. 1-3 depict an embodiment of a bag 100, according to the present disclosure. More specifically, FIG. 1 is a standard perspective view of the bag 100 in a closed or sealed state; FIG. 2 is a perspective view of the bag 100 of FIG. 1 in an open or unsealed state; and FIG. 3 is another perspective view of the bag 100 of FIG. 1 in an open or unsealed state that depicts a product 172 being removed from the bag 100. The bag 100 can also be referred to as a pouch or other packaging structure.

As shown in FIGS. 1-3, the bag 100 can include a first wall 110, a second wall 120, a third wall 130, and a fourth wall 140. The bag 100 can also include a fifth wall 150, and can be configured as a flat bottom bag. The bag 100 can also be configured as a quad-seal bag, a vertical machine bag, or any other suitable type of bag. In some embodiments, the first and second walls 110, 120 may also be referred to as front and rear walls, respectively. When used, directional terms, such as "front," "rear," "bottom," etc., are used with respect to the orientation shown in the corresponding figure. The terms are used for the sake of convenience and are not necessarily intended to be limiting. For example, the front wall could in fact be printed with material that is more suitable for a rear wall of a packaging (e.g., printed with nutritional information), such that the front wall in fact serves as a rear wall. In some embodiments, the third wall 130 and the fourth wall 140 can be referred to as first and second gussets, respectively. In other embodiments, the third wall 130 and the fourth wall 140 can be referred to as first and second sidewalls, respectively. The fifth wall 150 may also be referred to herein as the bottom wall or base.

Additionally, although FIGS. 1-3 primarily depict the first wall 110 and third wall 130, it will be appreciated that the second wall 120 and fourth wall 140 can include the same or similar features. For example, the fourth wall 140 may be the same as, or substantially the same as, the third wall 130. The second wall 120 may also be the same as, or substantially the same as, the first wall 110, except that the second wall 120 does not include an opening 190 and associated elements (e.g., label 160). As such, the discussion herein regarding many features of the first wall 110 and the third wall 130 is equally applicable to the second wall 120 and fourth 140, even though the features may not be specifically depicted.

With continued reference to FIGS. 1-3, the first wall 110, second wall 120, third wall 130, fourth wall 140, and fifth wall 150 can cooperate to define a cavity 170 in the interior of the bag 100. The cavity 170 may receive and retain a one or more products 172, as shown in FIGS. 1-3 where the individual products 172 are shown in phantom. At the user's discretion, the products 172 may be removed from the cavity 170 through an opening 190, as shown in FIG. 3.

Any suitable variety of products 172 may be retained within the cavity 170 of the bag 100. For example, the product 172 can comprise a food product, including but not limited to, cheese, crackers, cookies, snack bars, etc. In various embodiments, the bag 100 can be used advantageously to contain individually wrapped products 172. In some embodiments, the bag 100 is composed of a material suitable to act as a barrier layer to preserve the products 172 retained within the cavity 170. In others, such as those in which the products 172 are individually-wrapped, the bag 100 may be composed of a material that does not serve as a barrier layer.

In some embodiments, the product 172 comprises a beverage or canned food product. In such embodiments, the product 172 can be contained within a container. One or more containers may then be retained within the cavity 170 of the bag 100. Non-food products 172 can also be retained within the cavity 170 of the bag 100. For example, individually packaged non-food products can be retained within the cavity 170 of the bag 100. Containers containing non-food products can also be retained within the cavity 170 of the bag 100.

In some embodiments, the bag 100 may be described as being a gravity fed bag 100. For example, at a user's discretion, one or more products 172 may be withdrawn from the opening 190 of the bag 100. The remaining products 172, while still retained within the bag 100, may then move downward in response to gravitational forces (i.e., gravity). A user may thereafter remove one or more additional products 172 from the opening 190 of the bag 100 at their discretion. As can be appreciated, the products 172 may be retained within the bag 100 and kept from spilling out absent removal by a user.

The bag 100 may also be configured for easy access or ready snacking. In some embodiments, the contents (e.g., products 172, etc.) of the bag 100 may be accessed through the opening 190, for example, using a single hand when the bag 100 is resting on a surface (e.g., a shelf), or, as another example, one hand may be used merely to hold the bag 100 (e.g., at an upper portion 102 of the bag 100) while another hand is used to access the contents of the bag 100 through the opening 190.

In some embodiments, the bag 100 can be configured to stand upright. In other words, the bag 100 may be capable of standing on its own. The bag 100 may also be substantially capable of maintaining its structural conformation. As shown in FIGS. 1-3, the fifth wall 150 can serve as a base on which the bag 100 rests. The first wall 110, second wall 120, third wall 130, and fourth wall 140 extend upwardly from the fifth wall 150. The first wall 110, second wall 120, third wall 130, and fourth wall 140 can also be attached or otherwise directly coupled to the fifth wall 150. In other embodiments, one or more of the first wall 110, second wall 120, third wall 130, and fourth wall 140 may be integrally formed with the fifth wall 150.

In some embodiments, the first wall 110, second wall 120, third wall 130, and fourth wall 140 can be attached to the fifth wall 150 via one or more seams 182, 184, 186, 188. The seams 182, 184, 186, 188 can be formed by attaching or otherwise coupling the inner surfaces of two adjacent ends of the walls and/or gussets. The seams 182, 184, 186, 188 can protrude or otherwise extend outwardly and can provide increased stabilization to the bag 100. For example, the seams 182, 184, 186, 188 may assist in keeping the bag 100 from tipping over.

In the illustrated embodiment, the seams 182, 184, 186, 188 extend along the various ends or edges of the fifth wall 150, which serves as the base of the bag 100. For example, one seam 182 extends along the lower end 114 of the first wall 110 and couples the first wall 110 to the first end 152 of the fifth wall 150. Another seam 184 extends along the lower end 124 of the second wall 120 and couples the second wall 120 to the second end 154 of the fifth wall 150. Other seams 186, 188 extend along the lower ends 134, 144 of the third and fourth walls 130, 140 and couple the third and fourth walls 130, 140 to the third and fourth ends (or first and second side ends) 156, 158 of the fifth wall 150 in similar fashion.

In some embodiments, the arrangement of the seams 182, 184, 186, 188 may be such that the seams 182, 184, 186, 188 are relatively continuous around the base or fifth wall 150 of the bag 100. In other embodiments, the seams 182, 184, 186, 188 can extend only along one or more portions of the base or fifth wall 150 of the bag 100.

The bag 100 can also include an upper seam 180 that extends along an upper portion 102 of the bag 100. The upper seam 180 may extend along an upper end 112, 122 of the first and second walls 110, 120. As shown in FIG. 1, the upper seam 180 may also extend along the upper portion 102 of the bag 100 at a distance that is below the upper ends 112, 122 of the first and second walls 110, 120. The upper seam 180 can be used to attach or otherwise directly couple the first wall 110 to the second wall 120, as shown in FIGS. 1-3. In some embodiments, the upper seam 180 can also include a handle (such as the upper seam 880 and handle 811 shown in FIGS. 10-12). The upper seam 180 may also provide added stabilization and structural integrity to the bag 100. Other seams may also be used (such as the lateral seams 681 shown in FIGS. 6-7) to provide additional stabilization, relative rigidity, and/or structural integrity to the bag 100 as desired. In yet other embodiments, the bag 100 may be devoid of protruding seams (such as the bag 700 depicted in FIGS. 8-9).

The seams disclosed herein can be formed in various ways, and any suitable variety of seams may be used. In some embodiments, the seams include seals, such as heat seals. The seals can be configured to close (e.g., in an airtight, liquid-tight, and/or hermetic fashion) the bag 100. Any suitable variety of seals may be used. For example, in some embodiments, the seals comprise heat seals. In other embodiments, the seals may be formed via adhesive, ultrasonic welding or any other suitable method.

The strength of the seams and/or seals may be varied as desired. For example, the amount of energy imparted when forming a seal can determine whether the seal will be a peel seal that can be readily opened or a lock seal that is much stronger and much more difficult, or even impossible to open, without damaging the bag 100. In various embodiments, the seams (e.g., 180, 182, 184, 186, 188) comprise lock seals such that the products 172 are only intended to be removed through the opening 190 on the first wall 110. For example, once the cavity 170 of the bag 100 has been filled with a product 172, the upper seam 180 can be formed as a lock seal to close the upper portion of bag 100, after which the products 172 may only be intended to be removed through the opening 190 disposed on the first wall 110. In other embodiments, the upper seam 180 may comprise a peelable seal that can be readily opened, and the product 172 can be removed from the bag 100 either from the opening 190 in the first wall 110 or by the opening created by separating the upper seam 180.

With continued reference to FIGS. 1-3, it will be appreciated that the third and fourth walls 130, 140 may serve various functions. For example, the third and fourth walls 130, 140 can comprise a folded piece of material that is capable of transitioning from a flattened state to an expanded state. The third and fourth walls 130, 140 can also be configured to permit portions of the first and second walls 110, 120 to be spaced apart from each other as shown in the configuration depicted in FIGS. 1-3.

Figure 6:
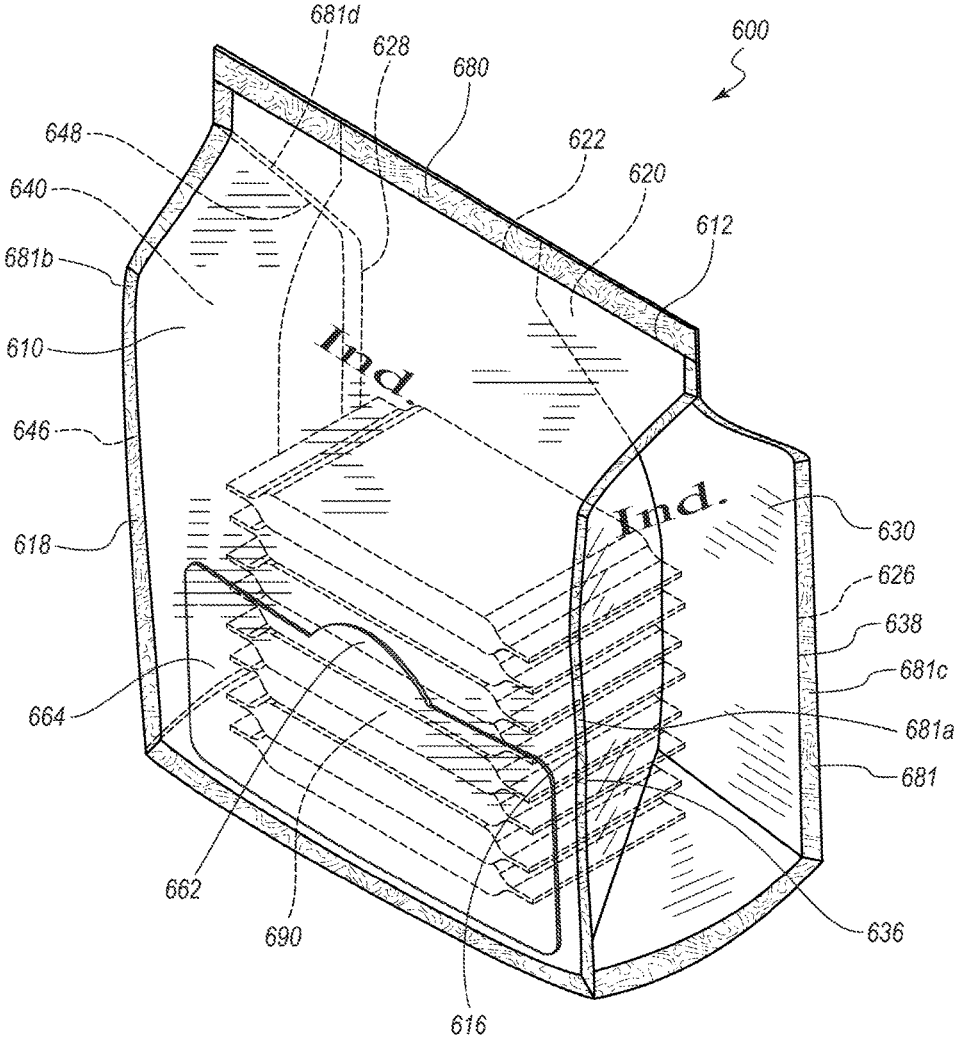
FIG. 6 is a perspective view of another embodiment of a bag in a closed or sealed state.
Figure 7:
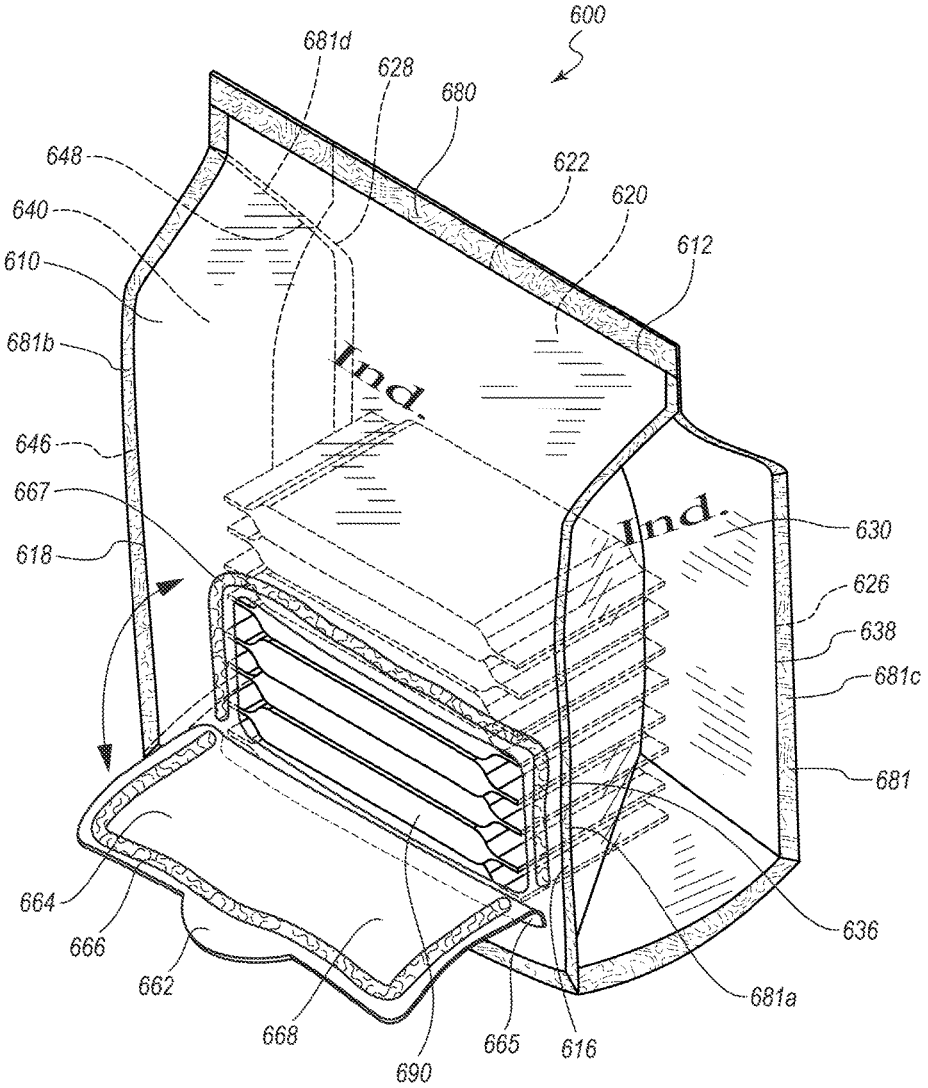
FIG. 7 is a perspective view of the bag of FIG. 6 in an open or unsealed state.

The third and fourth walls 130, 140 may also provide structural integrity to the bag 100. For example, as depicted in FIGS. 1-3, the third and fourth walls 130, 140 extend from the first wall 110 and the second wall 120. Stated otherwise, the third and fourth walls 130, 140 can be attached or otherwise directly coupled with each of the first and second walls 110, 120. The attachment of the third and fourth walls 130, 140 to the first and second walls 110, 120 may provide relative rigidity and assist in maintaining the structural integrity of the bag 100. Further, as shown in FIGS. 6-7 and discussed below, in some embodiments, lateral seams may be formed along the lateral ends of the first and second walls 110, 120 and the lateral ends of the third and fourth walls 130, 140 if desired.

As shown in FIGS. 1-3, the bag 100 also includes an opening 190. The opening 190 can be disposed along a lower portion 104 of the first wall 110 of the bag 100. In other embodiments, the opening 190 can be disposed along a portion of the second wall 120, the third wall 130, or the fourth wall 140. The opening 190 can also be disposed at various locations along the first wall 110, second wall 120, third wall 130, or fourth wall 140. For example, the opening 190 can be disposed along a lower portion 104, as shown in FIGS. 1-3. The opening 190 can also be disposed along a middle portion or an upper portion if desired. Further, the opening 190 can extend longitudinally, vertically, or at an angle (e.g., diagonally between longitudinal and vertical planes of the bag 100).

When the bag 100 is in the closed or sealed state as shown in FIG. 1, the opening 190 may be blocked, or otherwise closed, and access to the inner cavity 170 of the bag 100 may be denied or otherwise restricted. For example, a label 160 can be used to cover the opening 190 and deny access to the inner cavity 170 of the bag 100. In other embodiments, a flap may be used to cover the opening 190 (such as the flap 664 shown in FIGS. 6-7). In yet other embodiments, a tear-away strip of material may cover the opening 190 (such as the tear-away strip 793 of FIG. 8).

In the illustrated embodiment of FIG. 1, a label 160 is disposed over the opening 190. The label 160 can be adhesively attached or coupled to the first wall 110 of the bag 100. The label 160 can also be peelable and/or removable. For example, the label 160 can be partially, or completely, removed from the bag 100 as indicated by the reference arrow.

In some embodiments, the label 160 can include one or more pull tabs 162. The pull tabs 162 can be gripped by a user to assist in peeling or otherwise removing the label 160 from the bag 100. For example, a user may grasp the pull tab 162 and pull the label 160 away from the first wall 110 in the direction of the reference arrow to remove the label 160.

In some embodiments, the label 160 is non-resealable. In other words, the label 160 is intended to be removed from the bag 100 and discarded. In other embodiments, the label 160 can be resealable, and can be re-attached onto the first wall 110 of the bag at the discretion of the user. For example, the label 160 may comprise a resealable adhesive. The resealable adhesive can be disposed on a surface of the label 160 and/or an outer surface of the bag 100 (e.g., the first wall 110). A user may remove the label 160 to gain access to the products 172 within the bag 100. The user may thereafter place the label 160 back over the opening 190 and reseal the label 160 onto the first wall 110. Illustrative resealable adhesives that may be used include velcro adhesives (e.g., hook and loop fasteners and/or hook and hook fasteners), acrylic adhesives, polyurethane adhesives, hot melt adhesives, low tack adhesives, etc. Other types of resealable adhesives known to one skilled in the art can also be used.

In some embodiments, the opening 190 is formed by removing material from the first wall 110 during the manufacturing of the bag 100. For example, the opening 190 can be die cut out of the first wall 110. The opening 190 can also be laser perforated or scored and removed from the first wall 110. The opening 190 can also be cut with a blade. In other embodiments, material is not removed from the first wall 110 during the manufacturing of the bag 100 to form the opening 190. Rather, tear lines may be formed on the first wall 110 such that a segment of material from the first wall 110 may be torn, partially removed, or completely removed by a user when the bag 100 is initially opened. The tear lines can comprise one or more perforated lines. The tear lines can be die cut, laser perforated or scored, cut with a blade, or formed by other suitable methods.

In some embodiments, tear lines can be formed on the first wall 110 to define an opening region and a label 160 (or flap, etc.) can be placed over the tear lines and opening region. The label 160 (or flap, etc.) can also be coupled to or adhesively attached to the segment of material within the tear lines. As the label 160 (or flap, etc.) is removed, the segment of material from the first wall 110 that is coupled to or adhesively attached to the label 160 (or flap, etc.) may be torn along the tear line and removed from the first wall 110 thereby forming the opening 190. In yet other embodiments, the opening 190 may be opened and closed with a zipper seal.

As shown in FIGS. 2-3, when the bag 100 is in the open or unsealed state, the opening 190 provides access to the inner cavity 170 of the bag 100. For example, a user may extend at least a portion of a hand or hands into the opening 190 to access a product 172 which may thereafter be removed from, or otherwise pulled out of, the bag 100. As such, the opening 190 can be sized and/or shaped to provide adequate clearance for at least a part of a hand of a user to extend into the cavity 170 of the bag 100. In others, the opening 190 is sized to allow the product 172 to be shaken from the bag without being retrieved by a user's hand. As can be appreciated, however, the size and/or shape of the opening 190 can vary as desired. For example, the size and/or shape of the opening 190 can vary depending on the size and/or shape of the food product 172 that is contained in the bag 100. In some embodiments, for example, the opening 190 is substantially rectangular in shape. In other embodiments, the opening is substantially oval in shape. In some embodiments, the opening 190 extends longitudinally across the majority of the first wall 110. In other embodiments, the opening 190 extends longitudinally across only a portion of the first wall 110. Other shapes and/or sizes of openings 190 are also contemplated.

Any variety of materials may be used to form the bag 100. For example, in some instances, it can be desirable to select materials that are relatively stiff such that the bag 100 is sufficiently rigid to hold or maintain its structure or conformation. It may also be desirous to form a bag 100 that is relative flexible.

In some embodiments, the bag 100 comprises a single-layer film. In other embodiments, the bag 100 comprises a multi-layer film. In some embodiments, the film comprises one or more plastic and/or other polymeric materials. The bag 100 may also comprise a laminate or a coextruded material. In some embodiments, the bag 100 comprises a heat sealable material. Exemplary materials that may be used in forming the bag 100 include polyethylene polymers and copolymers, polypropylene polymers and copolymers, polyester polymers and copolymers, and/or polyamide polymers and copolymers. In some embodiments, the bag 100 may include paper and/or cardboard materials alone or in combination with films, laminates or coextruded materials. In other embodiments, the bag 100 does not include paper and/or cardboard materials. In some embodiments, the bag 100 includes polylactic acid (PLA). In yet further embodiments, the bag 100 includes cellulose materials such as cellophane. Other materials known to one of skill in the art can also be used.

If desired, the bag 100 can also include printed indicia 174 of any suitable variety. The printed indicia 174 may be disposed on any portion of the bag 100, such as the first wall 110, second wall 120, third wall 130, fourth wall 140 and/or fifth wall 150.

Figure 5A:
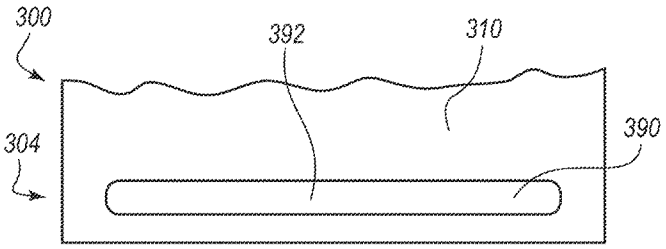
FIGS. 5A-5C are partial plan views of several embodiments of bags that depict variations of the opening on the first wall of the bags.
Figure 5B:
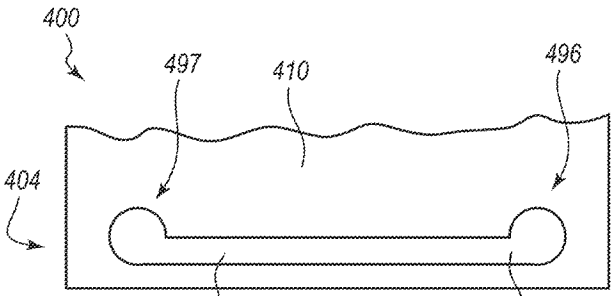
Figure 5C:
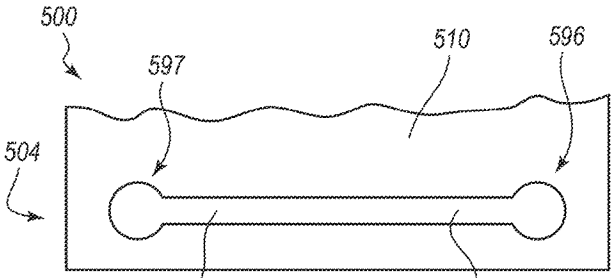
Figure 4:
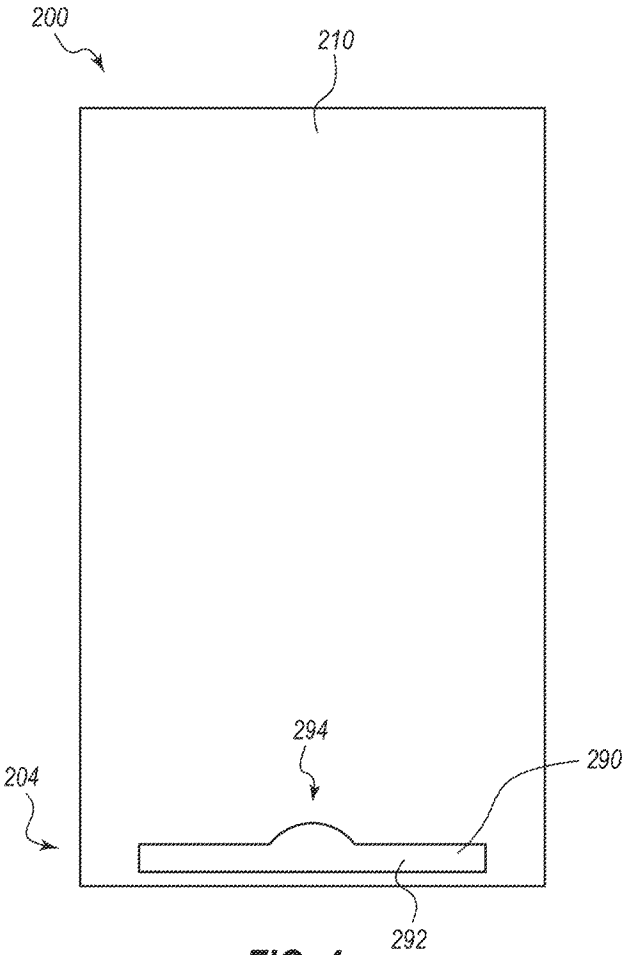
FIG. 4 is a plan view of an embodiment of a bag that depicts the opening on a first wall of the bag.

As previously mentioned, the shape and/or size of the opening 190 may vary as desired. Illustrative openings 290, 390, 490, 590, are depicted in FIG. 4 and FIGS. 5A-5C. FIG. 4 is a plan view of an embodiment of a bag 200 that depicts the opening 290 on a first wall 210 of the bag 200. FIGS. 5A-5C are partial plan views of several embodiments of bags 300, 400, 500 that depict variations in the opening 390, 490, 590 on the first wall 310, 410, 510 of the bags 300, 400, 500.

As shown in FIG. 4 and FIGS. 5A-5C, the opening 290, 390, 490, 590 may include an elongated portion 292, 392, 492, 592 that extends along the lower portion 204, 304, 404, 504 of the bags 200, 300, 400, 500. Additional material may also be removed from the first wall 210, 310, 410, 510 to make the opening 290, 390, 490, 590 more user friendly. For example, in FIG. 4, additional material has been removed from the first wall 210 near the center region 294 of the opening 290 such that the center portion of the opening 290 may open wider when a user inserts a hand. In FIGS. 5B and 5C, additional material has been removed from the first wall 410, 510 near the end regions 496, 497, 596, 597 of the opening 490, 590 such that the opening 490, 590 may open wider when a user inserts their hand. Other shapes and/or sizes of openings 290, 390, 490, 590 may also be used.

FIGS. 6 and 7 depict another embodiment of a bag 600 that can resemble the bag 100 described above in certain respects. Accordingly, like features are designated with like reference numerals, with the leading digits incremented to "6." Relevant disclosure set forth above regarding similarly identified features thus may not be repeated hereafter. Moreover, specific features of the bag 600 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the bag 600. Any suitable combination of the features and variations of the same described with respect to the bag 100 can be employed with the bag 600, and vice versa. This pattern of disclosure applies equally to further embodiments depicted in subsequent figures and described hereafter, wherein the leading digits may be further incremented.

As shown in FIGS. 6 and 7, in some embodiments, the bag 600 includes lateral seams 681 that may be used to attach the lateral ends 616, 618, 626, 628 of the first and second walls 610, 620, and the lateral ends 636, 638, 646, 648 of the third and fourth walls 630, 640. More specifically, a first lateral end 616 of the first wall 610 is attached to the first lateral end 636 of the third wall 630 to form lateral seam 681*a*; a second lateral end 618 of the first wall 610 is attached to the first lateral end 646 of the fourth wall 640 to form lateral seam 681*b*; a first lateral end 626 of the second wall 620 is attached to the second lateral end 638 of the third wall 630 to form lateral seam 681*c*; and a second lateral end 628 of the second wall 620 is attached to the second lateral end 648 of the fourth wall 640 to form lateral seam 681*d*. As previously discussed, the seams 681 can be formed by attaching the inner surfaces of the walls 610, 620, 630, 640.

In some embodiments, the lateral seams 681 can include seals (e.g., heat seals), and may provide added stability to the bag 600. Additionally, the lateral seams 681 can include lock seals that extend along each of the lateral edges of the bag 600. As previously discussed, lock seals can be difficult to open, and are often intended to remain closed.

As further shown in FIGS. 6 and 7, an upper seam 680 is disposed at the upper end of the bag 600. More specifically, the upper seam 680 attaches the upper end 612 of the first wall 610 to the upper end 622 of the second wall 620. As previously discussed, the upper seam 680 can be a lock seal, or a peelable seal, depending on the desired configuration of the bag 600.

In the illustrated embodiment, the bag 600 also includes a flap 664. In some embodiments, the flap 664 is resealably attached to the first wall 610. The flap 664 can be configured to open and close to allow or deny access to the contents of the bag 600. For example, in the closed state depicted in FIG. 6, the flap 664 can be coupled to or adhered to the first wall 610 of the bag 600. The flap 664 also covers the opening 690 of the bag 600 thereby denying access to the contents of the bag 600.

In the open state depicted in FIG. 7, the flap 664 has been opened and access to the contents of the bag 600 is allowed. In the open state, a portion 665 of the flap 664 remains coupled to or adhered to the first wall 610 of the bag 600. In the illustrated embodiment, the portion 665 of the flap 664 that remains coupled to or adhered is attached to the first wall 610 at a position that is lower than or otherwise below the opening 690, and the flap 664 is opened substantially downward. As indicated by the reference arrow, the flap 664 may opened and closed at the discretion of the user. In other embodiments, the portion 665 of the flap 664 that remains coupled to or adhered can be attached to the first wall 610 at a position that is above the opening 690, and the flap 664 can open substantially upwards. Similarly, the portion 665 of the flap 664 that remains coupled to or adhered can also be attached to the first wall 610 on either side of the opening 690.

The flap 664 can include a pull tab 662 to aid the user in opening and/or closing the flap 664. The flap 664 can also include an adhesive region 666 disposed on an inner surface 668 of the flap 664. An adhesive region 667 can also be disposed on an outer surface of the bag 600 (e.g., the first wall 610). The adhesive regions 666, 667 can cooperate together, or can operate independently. In some embodiments, only one adhesive region 666, 667 is used. The adhesive region 666, 667 can be configured to resealably attach the flap 664 (or a label 160 as shown in FIGS. 1-3) to the first wall 610 of the bag 600. The adhesive region 666, 667 can comprise any suitable type of resealable adhesive. For example, the adhesive region 666, 667 can comprise a velcro adhesive (e.g., hook and loop fasteners and/or hook and hook fasteners). A velcro adhesive disposed on the flap 664 can selectively mate with a velcro adhesive that may be disposed on the first wall 610 of the bag 600. Other types of resealable adhesives known to one skilled in the art can also be used. For example, the resealable adhesive can include acrylic adhesives, polyurethane adhesives, and/or hot melt adhesives. Low tack adhesives can also be used.

In some embodiments, the flap 664 (or label 160 as shown in FIGS. 1-3) can be closed mechanically using one or more closing elements. For example, the bag 600 can include one or more snaps, interlocks, latches, zippers, or other closing elements. The closing elements can be used in place of, or in addition to, an adhesive region 666, 667.

In some embodiments, tear lines can be formed on the first wall 610 to define an opening region and a flap 664 can be placed over the tear lines and opening region. The flap 664 can also be coupled to or adhesively attached to the segment of material within the tear lines. As the flap 664 is removed, the segment of material from the first wall 610 that is coupled to or adhesively attached to the flap 664 may be torn along the tear line and removed from the first wall 610 thereby forming the opening 690.

Figure 8:
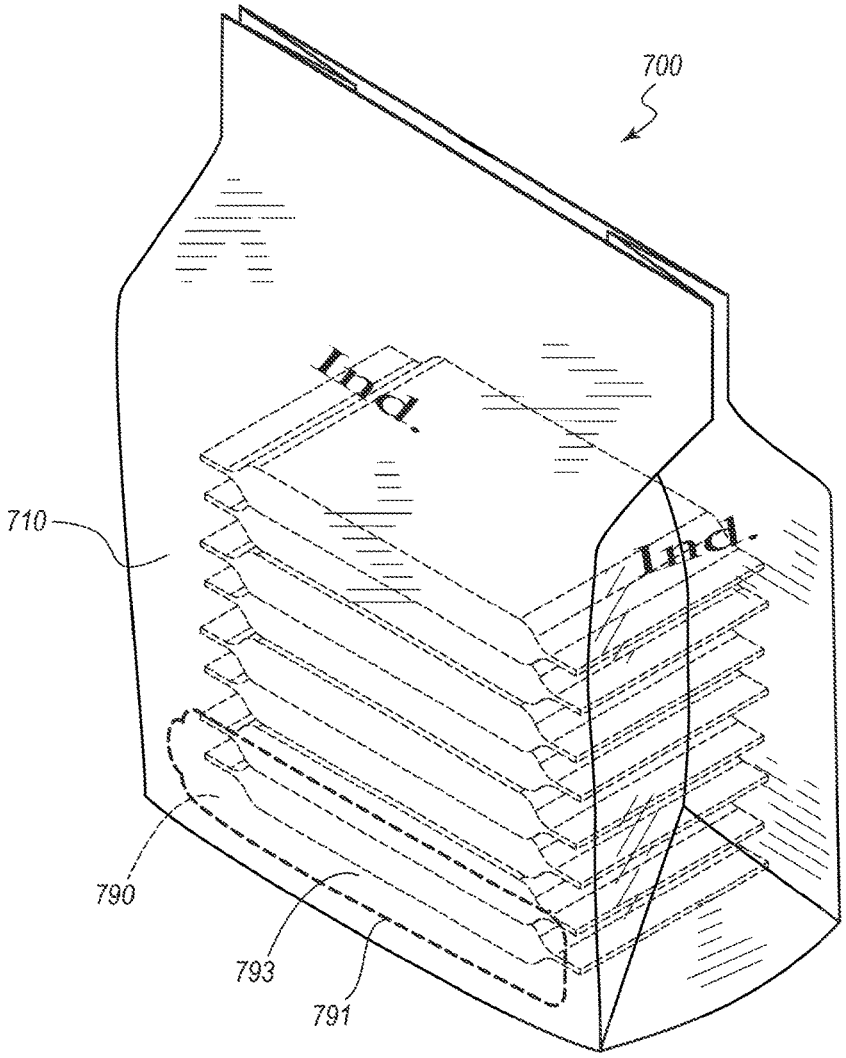
FIG. 8 is a perspective view of another embodiment of a bag in a closed or sealed state.
Figure 9:
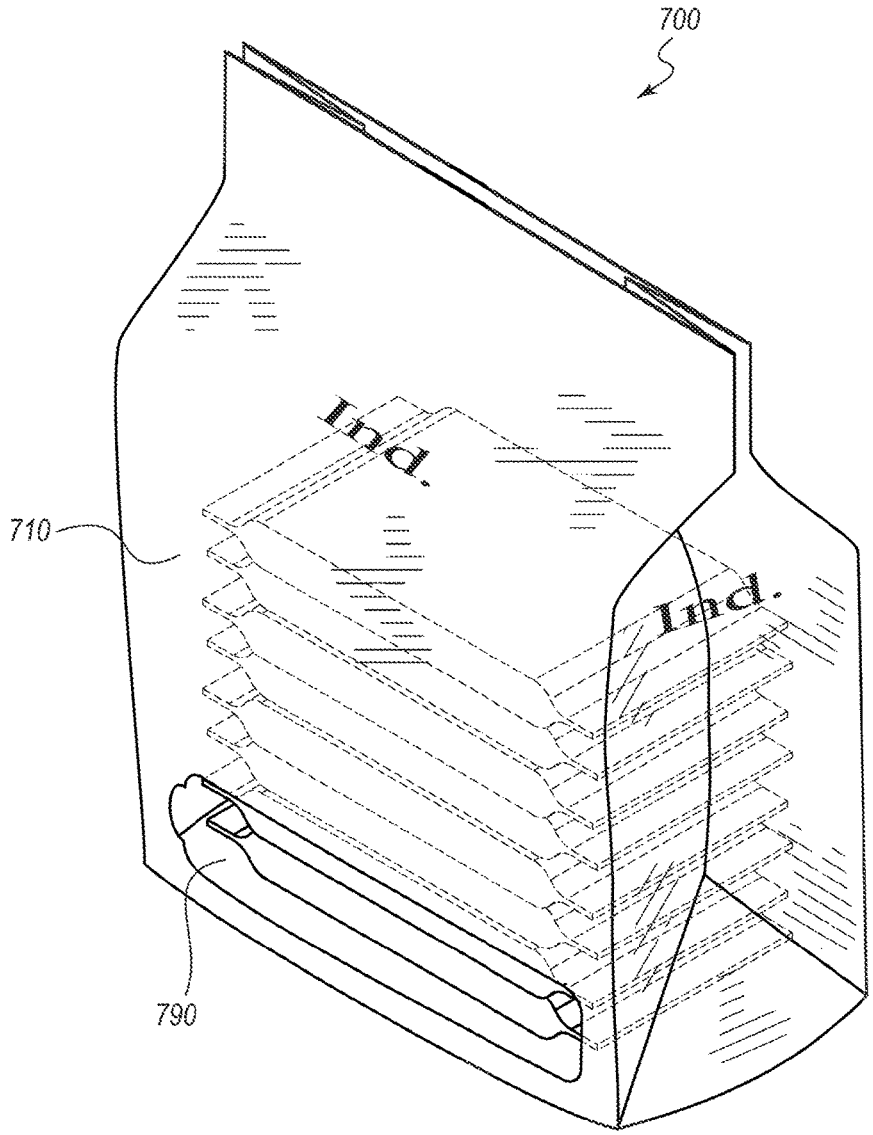
FIG. 9 is a perspective view of the bag of FIG. 8 in an open or unsealed state.

FIGS. 8 and 9 depict another embodiment of a bag 700 in a closed and open state. More specifically, FIG. 8 depicts the bag 700 in a closed state, and FIG. 9 depicts the bag 700 in an open state. As shown in FIG. 8, the bag 700 is devoid of protruding seams or seals. The first wall 710 also includes a tear line 791 such that a tear-away strip 793 of material may be partially or completely removed from the first wall 710 to form the opening 790 in the bag 700. At the discretion of the user, the tear-away strip 793 of material can be torn and removed along the tear line 791 to provide access to the contents of the bag 700 through the opening 790 as shown in FIG. 9. The tear lines 791 can comprise one or more perforated lines. The tear lines 791 can be die cut, laser perforated or scored, cut with a blade, or formed by other suitable methods. As previously mentioned, the use of a tear line 791 and tear-away strip 793 may also be used in combination with a label or flap if desired.

In some embodiments, the tear-away strip 793 can be configured such that it is only partially removed from the first wall 710 to form the opening 790. For example, the tear lines 791 can extend such that a portion of the tear-away strip 793 is configured to remain coupled to the first wall 710 of the bag 700 after opening. As can be appreciated, in such embodiments, the tear-away strip 793 can be, in some ways, analogous to a flap.

Figure 10:
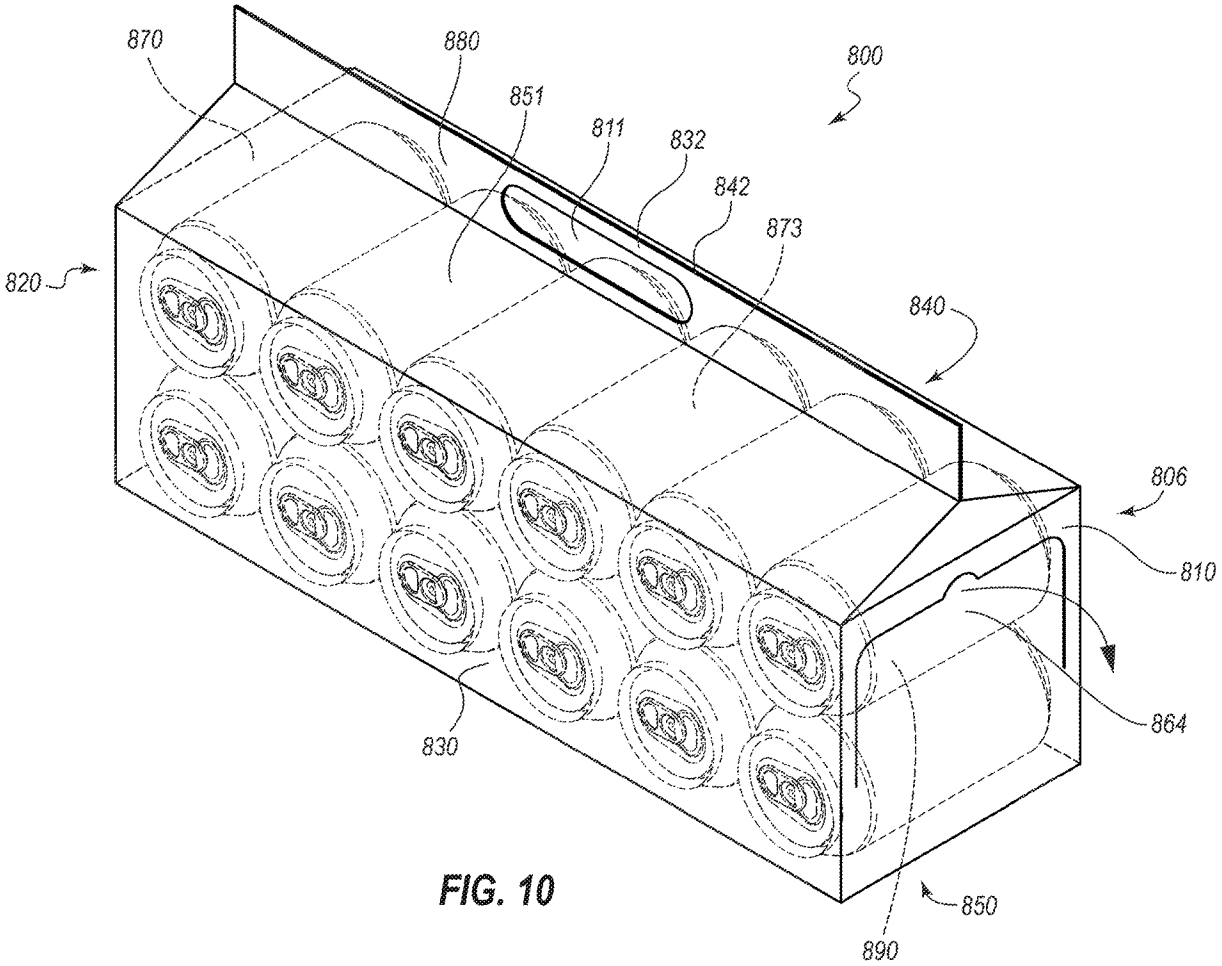
FIG. 10 is a perspective view of another embodiment of a bag in a closed or sealed state.
Figure 11:
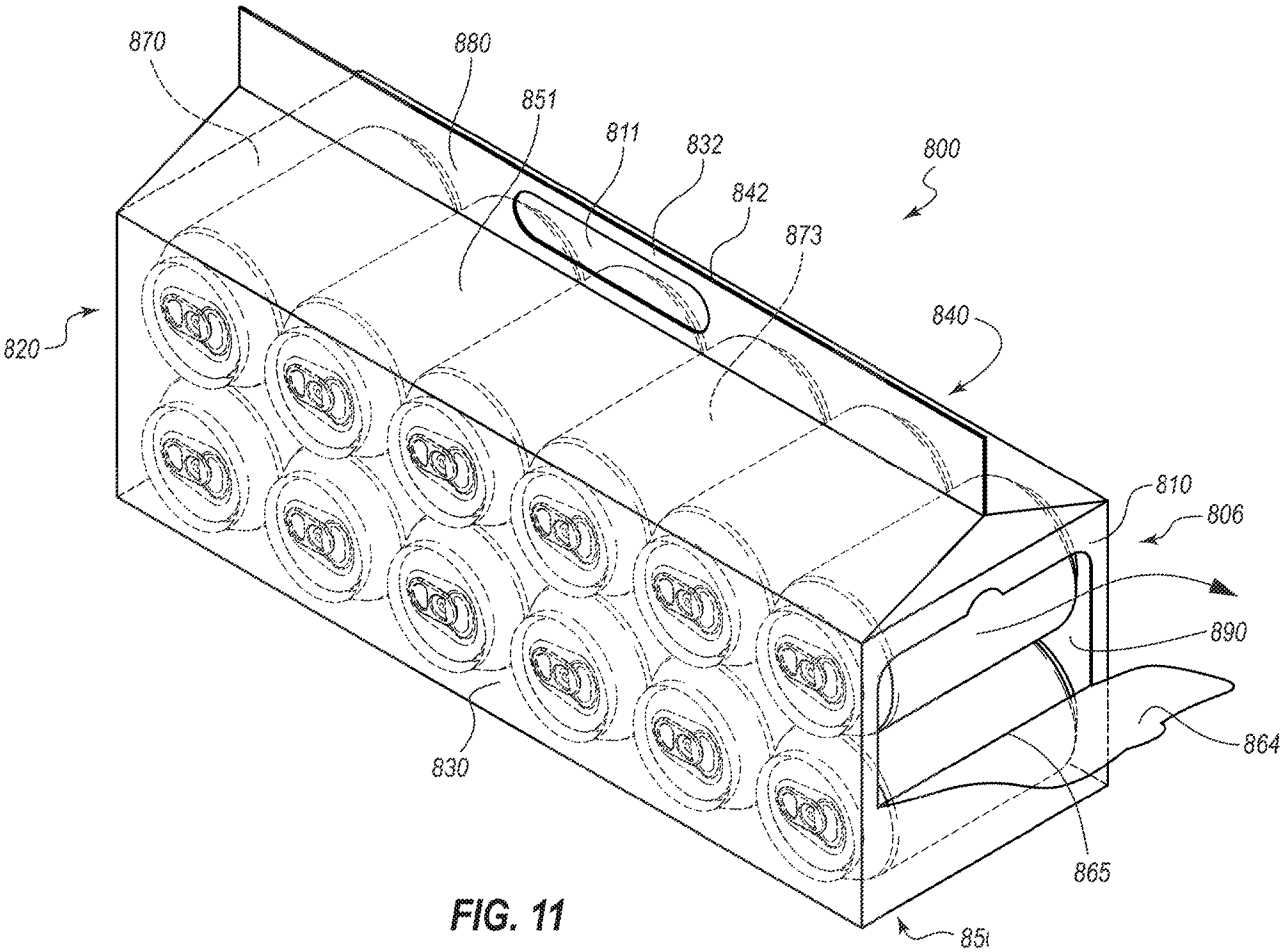
FIG. 11 is a perspective view of the bag of FIG. 10 in an open or unsealed state.
Figure 12:
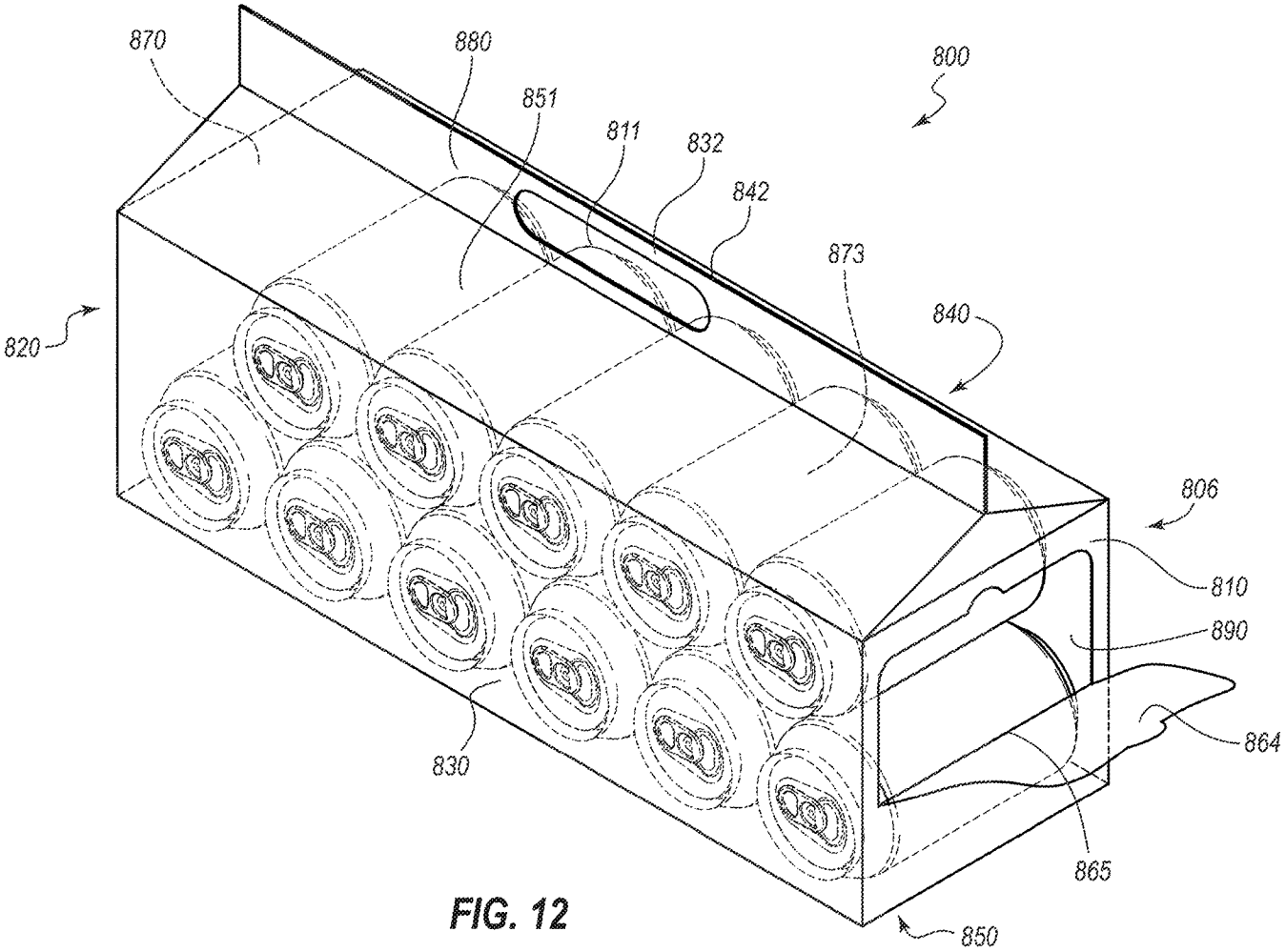
FIG. 12 is another perspective view of the bag of FIG. 10 in an open or unsealed state.

FIGS. 10-12 depict another embodiment of a bag 800, according to the present disclosure. More specifically, FIG. 10 depicts the bag 800 in a closed state; FIG. 11 depicts the bag 800 in an open state; and FIG. 12 depicts the bag 800 in an open state after the removal of one or more containers 873. As can be appreciated, the orientation of the containers 873 in the illustrated embodiment is intended to be exemplary. For example, the containers 873 depicted in the illustrated embodiment are disposed substantially sideways, or on their sides. In other embodiments, the containers 873 can be disposed upright or standing up. Other orientations can also be used as desired.

As shown in FIGS. 10-12, the bag 800 can comprise a first wall 810, a second wall 820, a third wall 830, a fourth wall 840, and a fifth wall 850. The walls 810, 820, 830, 840, 850 can cooperate to define at least a portion of a cavity 870 on the interior of the bag 800. As shown in the illustrated embodiment, one or more containers 873 can be retained within the cavity 870. As can be appreciated, the containers 873 can be analogous to the products discussed above (such as the products 172 of FIGS. 1-3). In some embodiments, the containers 873 can comprise beverage containers, food containers, or non-food containers. Further, in embodiments wherein the containers 873 comprise beverage containers, the size and/or footprint of the bag 800 can be substantially the same as the size and/or footprint of traditional paperboard packaging materials if desired. For example, in some embodiments, the size and/or footprint of the bag 800 can be the same as, or substantially the same as, the size and/or shape of traditional Fridge Pack packaging used to package similar beverage containers.

The bag 800 further comprises an opening 890. The opening 890 is disposed at an upper portion 806 of the first wall 810. In other embodiments, the opening 890 can be disposed at an intermediate or middle portion, or at a lower portion (such as the opening 190 shown in FIGS. 1-3). As can be appreciated, the opening 890 can be analogous to other openings disclosed herein (e.g., the opening 190 of FIGS. 1-3). In some embodiments, the opening 890 can further extend beyond the first wall 810 onto one or more additional walls, surfaces, or regions of the bag 800. For example, the opening 890 can extend onto a portion of the third and/or fourth walls 830, 840. The opening 890 can also extend onto an upper surface of the bag 800, such as the upper surface 851 if desired.

In the illustrated embodiment of FIGS. 10-12, the opening 890 can be opened and/or closed by a flap 864. The flap 864 can be analogous to the flap discussed above (such as the flap 664 of FIGS. 6-7). In some embodiments, the flap 864 can be resealably attached to the first wall 810. For example, the flap 864 can be configured to open and close to allow or deny access to the contents of the bag 800. One or more adhesive regions can be used (as discussed above in FIGS. 6-7). Further, a portion 865 of the flap 864 can be configured to remain coupled to or adhered to the first wall 810 of the bag 800, thereby facilitating the opening and/or closing of the flap 864. In other embodiments, the flap 864 can be torn and removed from the bag 800 and discarded.

In the closed state depicted in FIG. 10, the flap 864 can be adhered to the first wall 810 of the bag 800. The flap 864 also covers the opening 890 of the bag 800 thereby enclosing the containers 873 within the bag 800. At the user's discretion, the flap 864 can be pulled or otherwise opened to allow access to the containers 873, as indicated by the reference arrow of FIG. 10. As shown in FIGS. 11-12, in the open state, access to the containers 873 within the bag 800 is allowed. A user can extend at least a portion of a hand into the bag 800 to access one or more containers 873. The one or more containers 873 can then be removed from the bag 800 via the opening 890, as indicated by the reference arrow of FIG. 11.

In some embodiments, the remainder of the containers 873 within the cavity 870 of the bag 800 can move (e.g., roll or slide) in response to the removal of one or more containers 873 from the opening 890. For example, gravitation forces acting on the containers 873 can cause the containers 873 to move downward and/or outward to fill a void that may be left by removal of a container 873 near the opening 890.

In some embodiments, a label can be used in place of the flap 864. The label can be configured to cover the opening 890 and enclose the inner cavity 870 of the bag 800 (such as the label 160 shown in FIGS. 1-3). For example, the label can be adhesively attached or coupled to the first wall 810 of the bag 800. The label can also be peelable and/or removable. For example, the label can be partially, or completely, removed from the bag 800. In further embodiments, the label can be resealable.

In yet other embodiments, a tear-away strip of material may be used to cover the opening 890 (such as the tear-away strip 793 of FIGS. 8-9). For example, the tear-away strip of material can be torn and partially or completely removed along a tear line to provide access to the containers 873 within the bag 800 through the opening 890. The tear lines can comprise one or more perforated lines. The tear lines can be die cut, laser perforated or scored, cut with a blade, or formed by other suitable methods. The use of a tear line and tear-away strip can also be used in combination with a label or flap 864 if desired.

With continued reference to FIGS. 10-12, the bag 800 can further comprise a handle 811. In some embodiments, the handle 811 is integral with the bag 800. For example, the handle 811 can extend through a portion of the bag 800. In some embodiments, the handle 811 can be formed within one or more walls of the bag 800. In the illustrated embodiment, for example, the handle 811 is formed such that it extends through a portion of the third and fourth walls 830, 840. Further, in some embodiments, the handle 811 is formed such that extends through an upper seam 880 that extends along an upper portion of the bag 800. As shown in FIGS. 10-12, the upper seam 880 can extend along an upper end 832, 842 of the third and fourth walls 830, 840. In other embodiments, the handle 811 can be coupled to a surface 851 (e.g., an upper surface) of the bag 800.

The handle 811 can be formed in various ways. In some embodiments, the handle 811 is die-cut. In other embodiments, the handle 811 is laser cut. In yet other embodiments, the handle 811 is cut with a blade. Other methods of forming the handle 811 can also be used.

Figure 13B:
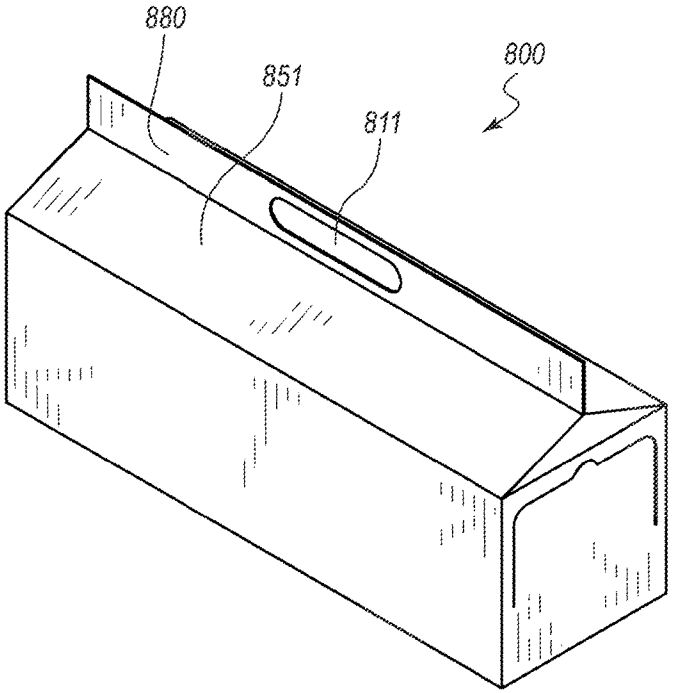
FIGS. 13A-13B are additional perspective views of the bag of FIG. 10.
Figure 13A:
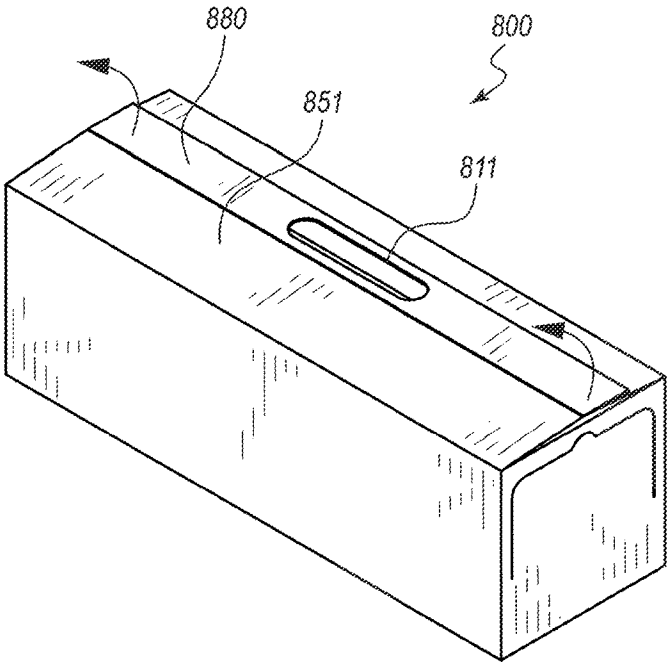

FIGS. 13A-13B depict additional perspective views of the bag 800 of FIG. 10. More specifically, in FIG. 13A, the bag 800 is depicted with the handle 811 in a folded configuration, and in FIG. 13B, the bag 800 is depicted with the handle 811 in an extended configuration. As shown in FIG. 13A, in the folded configuration, the handle 811 can be folded such that it is substantially flat along a surface 851 (e.g., an upper surface) of the bag 800. At the discretion of the user, the handle 811 can be unfolded. The handle 811 can then be extended upwards to facilitate carrying and handling the bag 800, as shown in FIG. 13B.

Figure 14:
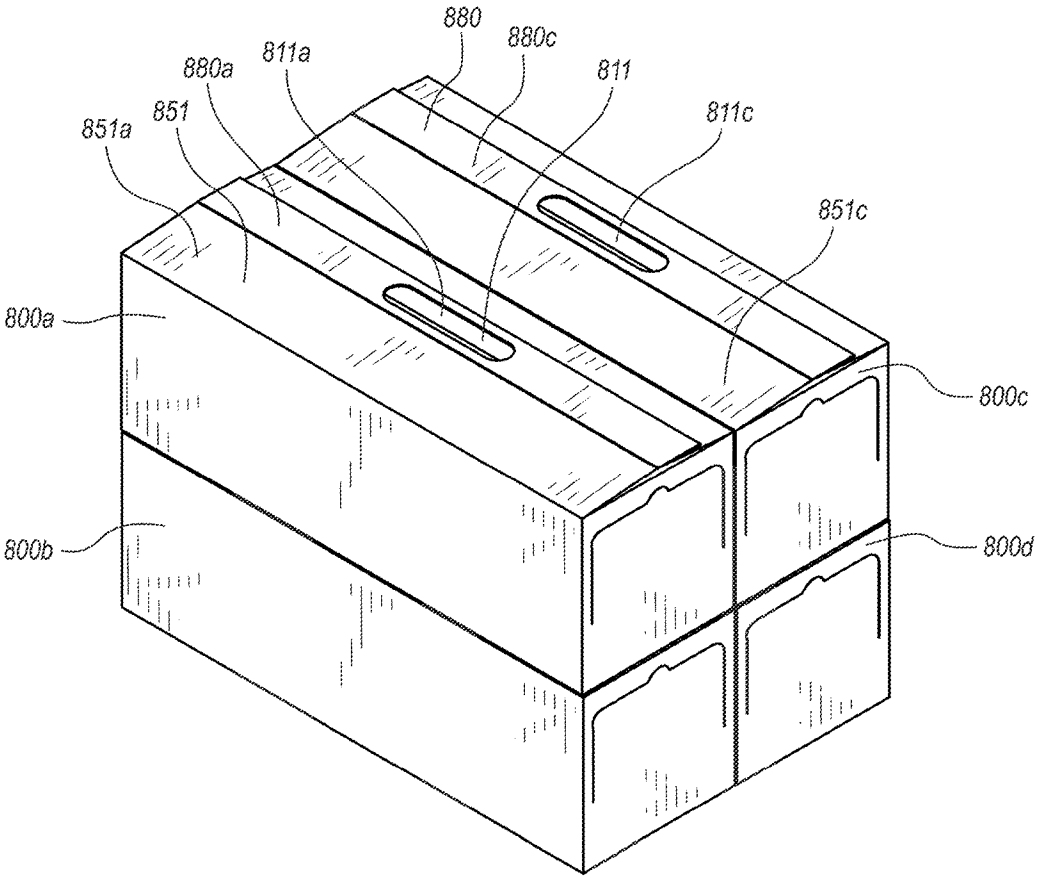
FIG. 14 is a perspective view of a plurality of bags of FIG. 10 in a stacked configuration.

FIG. 14 depicts a perspective view of a plurality of bags 800 of FIG. 10 in a stacked configuration. As shown in FIG. 14, in some embodiments, the bags 800 can be stackable. For example, in the illustrated embodiment, four bags 800*a*, 800*b*, 800*c*, 800*d* are depicted in a stacked configuration where a first bag 800*a* is stacked on a second bag 800*b*, and a third bag 800*c* is stacked on a fourth bag 800*d*. Further, in the illustrated embodiment, the handles 811 and seams 880 are in a folded configuration such that they are folded to a position that is substantially flat on the surface 851 of the package. This is illustrated in the first and third bags 800*a*, 800*c*, wherein the handles 811*a*, 811*c* and seams 880*a*, 880*c* are depicted in a position that is folded substantially flat on the surface 851*a*, 851*c* of the bags 800*a*, 800*c*. As can be appreciated, the handles 811 and seams 880 of the second and fourth bags 800*b*, 800*d* can be folded in a substantially similar configuration.

In some embodiments, the bags 800 can also be refrigerator or cooler friendly. For example, in some embodiments, the bags 800 can be formed of materials (films, etc.) that are not substantially affected by ice or water. This can be advantageous in situations where the bags 800 are used to retain one or more containers 873 that are intended to be served cold (e.g., beverage containers, etc.), or that need to be kept cold (e.g., perishable products). This can also be advantageous when compared to traditional paperboard packaging materials.

In further embodiments, the bags 800 can include one or more transparent portions. For example, in some embodiments, the bags 800 can comprise a transparent film material. In some embodiments, the entirety of the bag 800 can be substantially transparent. In other embodiments, only one or more portions of the bag 800 are substantially transparent. For example, the bag 800 can be cut to include one or more apertures or window regions. A substantially transparent material can thereafter be coupled or adhered to the bag 800 around the aperture or window region. In other embodiments, one or more transparent portions can be formed by selectively printing or coloring the bag 800 in a pattern that provides one or more substantially transparent regions.

As can be appreciated, the size of the disclosed bags can vary. For example, the bag can be shorter or longer than what is depicted in the illustrated embodiments of FIGS. 1-14. For example, in some embodiments, a ratio of the height of a bag to its width can be less than, or greater than, what is shown in FIGS. 1-14. Other relative configurations are also contemplated.

In various embodiments, the bag may be configured as a stand-alone package. For example, the bag may be capable of standing on its own, and may be presented independently or individually on a market shelf. In other embodiments, multiple bags may be packaged together, such as in shrink-wrap packaging. In still other or further embodiments, one or multiple bags may be packaged in a box.

Although much of the foregoing disclosure is discussed in the context of packaging for food, it should be appreciated that embodiments of bags disclosed herein may be used for non-food items. The bags may be formed in a variety of sizes and configurations. In some instances, some variations in addition to size may exist between the smaller and larger format bags. For example, in some embodiments, larger format bags may be formed of a stiffer material. The stiffer material may aid in maintaining the bag shape and allowing the bag to stand on its own. The stiffer material also may aid in maintaining the opening in an open state, as a width of the opening can be bigger for the larger format packages. Other alterations are also possible, such as omitting or including various seams or seals and/or, where seams or seals are present, increasing or decreasing a width of each seam or seal.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

References to approximations are made throughout this specification, such as by use of one or more of the terms "about," "approximately," "substantially," and "generally." For each such reference, it is to be understood that, in some embodiments, the value, feature, or characteristic may be specified without approximation. For example, where such a qualifier is used, the term includes within its scope the qualified word in the absence of the qualifier.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment. Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any embodiment requires every feature shown in a particular drawing.

Unless otherwise noted, the terms "a" or "an" are to be construed as meaning "at least one of." In addition, for ease of use, the words "including" and "having" are interchangeable with and have the same meaning as the word "comprising." Recitation of the term "first" with respect to a feature or element does not necessarily imply the existence of a second or additional such feature or element.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. The scope of the invention is therefore defined by the following claims and their equivalents.

The invention claimed is:

1. A bag, comprising:

a first wall comprising an upper end, a lower end, a first lateral end, and a second lateral end, wherein the lower end is attached to a first end of a fifth wall;

a second wall comprising an upper end, a lower end, a first lateral end, and a second lateral end, wherein the lower end is attached to a second end of the fifth wall, wherein the upper end of the second wall is configured to be directly coupled to the upper end of the first wall;

a third wall extending from the first lateral end of the first wall to the first lateral end of the second wall;

a fourth wall extending from the second lateral end of the first wall to the second lateral end of the second wall; and an opening that is disposed on a lower portion of the first wall of the bag, wherein an upper edge of the opening is disposed on the lower portion of the first wall, wherein a width of the opening is greater than a width of each of the third and fourth walls;

a flap that is resealably attached to the first wall of the bag, wherein a portion of the flap remains attached to the first wall when the bag is in an open state, wherein the portion of the flap is attached to the first wall at a position that is below the opening such that the flap opens in a substantially downward direction;

wherein the first wall, the second wall, the third wall, the fourth wall, and the fifth wall cooperate to define at least a portion of a cavity on the interior of the bag, and wherein the opening provides access to the cavity.

2. The bag of claim 1, wherein the upper end of the first wall is directly coupled to the upper end of the second wall.

3. The bag of claim 1, wherein the flap comprises an adhesive region disposed on an inner surface of the flap, the adhesive region comprising a resealable adhesive that is configured to attach the flap to the first wall of the bag.

4. The bag of claim 3, wherein the adhesive region comprises a hook and hook fastener or a hook and loop fastener.

5. The bag of claim 3, wherein the adhesive comprises at least one of an acrylic adhesive or a polyurethane adhesive.

6. The bag of claim 1, wherein the bag comprises a single-layer film.

7. The bag of claim 1, wherein the bag comprises a multi-layer film.

8. The bag of claim 1, wherein the flap comprises a pull tab.

9. A bag, comprising:

a first wall comprising an upper end, a lower end, a first lateral end, and a second lateral end, wherein the lower end attaches to a first end of a fifth wall to form a first seam, wherein the first lateral end of the first wall and the second lateral end of the first wall define a width of the first wall;

a second wall comprising an upper end, a lower end, a first lateral end, and a second lateral end, wherein the lower end attaches to a second end of the fifth wall to form a second seam, wherein the first lateral end of the second wall and the second lateral end of the second wall define a width of the second wall, wherein the upper end of the second wall is configured to be directly coupled to the upper end of the first wall;

a third wall extending from the first lateral end of the first wall to the first lateral end of the second wall, wherein a first lateral end of the third wall and a second lateral end of the third wall define a width of the third wall;

a fourth wall extending from the second lateral end of the first wall to the second lateral end of the second wall, wherein a first lateral end of the fourth wall and a second lateral end of the fourth wall define a width of the fourth wall;

an opening that is disposed on a lower portion of the first wall of the bag, wherein an upper edge of the opening is disposed on the lower portion of the first wall;

a flap that is resealably attached to the first wall of the bag, wherein a portion of the flap remains attached to the first wall when the bag is in an open state, wherein the portion of the flap is attached to the first wall at a position that is below the opening such that the flap opens in a substantially downward direction;

wherein each of the width of the first wall and the width of the second wall is greater than each of the width of the third wall and the width of the fourth wall;

wherein the first wall, the second wall, the third wall, the fourth wall, and the fifth wall cooperate to define at least a portion of a cavity on the interior of the bag, and wherein the opening provides access to the cavity.

10. The bag of claim 9, wherein the first seam comprises a heat seal.

11. The bag of claim 9, wherein the third wall attaches to the first lateral end of the first wall to form third seam that extends along the lateral end of the first wall.

12. The bag of claim 9, wherein the flap comprises an adhesive region disposed on an inner surface of the flap, the adhesive region comprising a resealable adhesive that is configured to attach the flap to the first wall of the bag.

13. The bag of claim 12, wherein the adhesive region comprises a hook and hook fastener or a hook and loop fastener.

14. The bag of claim 12, wherein the adhesive comprises at least one of an acrylic adhesive or a polyurethane adhesive.

15. The bag of claim 9, wherein the bag comprises a single-layer film.

16. The bag of claim 9, wherein the bag comprises a multi-layer film.

17. The bag of claim 9, wherein the flap comprises a pull tab.

18. A bag, comprising:

a first wall comprising an upper end, a lower end, a first lateral end, and a second lateral end, wherein the lower end is attached to a first end of a fifth wall, wherein the first lateral end of the first wall and the second lateral end of the first wall define a width of the first wall;

a second wall comprising an upper end, a lower end, a first lateral end, and a second lateral end, wherein the lower end is attached to a second end of the fifth wall, wherein the first lateral end of the second wall and the second lateral end of the second wall define a width of the second wall, wherein the upper end of the second wall is configured to be directly coupled to the upper end of the first wall;

a third wall extending from the first lateral end of the first wall to the first lateral end of the second wall, wherein a first lateral end of the third wall and a second lateral end of the third wall define a width of the third wall;

a fourth wall extending from the second lateral end of the first wall to the second lateral end of the second wall, wherein a first lateral end of the fourth wall and a second lateral end of the fourth wall define a width of the fourth wall;

an opening that is disposed on a lower portion of the first wall of the bag, wherein an upper edge of the opening is disposed on the lower portion of the first wall;

a flap that is resealably attached to the first wall of the bag, wherein a portion of the flap remains attached to the first wall when the bag is in an open state, wherein the portion of the flap is attached to the first wall at a position that is below the opening such that the flap opens in a substantially downward direction;

wherein each of the width of the first wall and the width of the second wall is greater than each of the width of the third wall and the width of the fourth wall;

wherein the first wall, the second wall, the third wall, the fourth wall, and the fifth wall cooperate to define at least a portion of a cavity on the interior of the bag, and wherein the opening provides access to the cavity.

19. The bag of claim 18, wherein the flap comprises an adhesive region disposed on an inner surface of the flap, the adhesive region comprising a resealable adhesive that is configured to attach the flap to the first wall of the bag.

20. The bag of claim 19, wherein the adhesive region comprises a hook and hook fastener or a hook and loop fastener.

* * * * *